United States Patent [19]

Schneider

[11] 4,287,932

[45] Sep. 8, 1981

[54] PROCESS FOR THE PRECISION MOLDING OF CASTINGS

[75] Inventor: Hans Schneider, Winterthur, Switzerland

[73] Assignee: Sulzer Brothers Limited, Winterthur, Switzerland

[21] Appl. No.: 179,674

[22] Filed: Aug. 20, 1980

[30] Foreign Application Priority Data

Sep. 10, 1979 [CH] Switzerland ..... 8131/79

[51] Int. Cl.[3] ..... B22D 29/00

[52] U.S. Cl. ..... 164/516; 164/132; 164/35; 164/36

[58] Field of Search ..... 164/34–36, 164/24–26, 131, 132, 41; 249/175, 114, 115, 135

[56] References Cited

U.S. PATENT DOCUMENTS 1,025,469 5/1912 Hunter ..... 164/132

1,109,886 9/1914 Von Welsbach ..... 164/132

*Primary Examiner*—Robert D. Baldwin

*Assistant Examiner*—K. Y. Lin

*Attorney, Agent, or Firm*—Kenyon & Kenyon

[57] ABSTRACT

The material used for the production of cores for precision molds is a metal which is oxidizable at relatively low temperatures, i.e., below the solidification temperature of the melts for pouring, and which passes directly from the solid state to the gas state by oxide sublimation. This greatly speeds up the dissolving of cores, particularly small diameter cores, out of the castings.

11 Claims, No Drawings

PROCESS FOR THE PRECISION MOLDING OF CASTINGS

This invention relates to a process for the precision molding of castings. More particularly, this invention relates to a process for the production of castings by precision molding using lost patterns with inserted cores.

Heretofore, it has been known to produce castings with narrow holes by precision molding techniques wherein a lost pattern is first formed with at least one inserted core and a ceramic mold is then made using the pattern and core. After making the ceramic mold, the pattern is usually eliminated out of the mold. Next, the mold is usually fired and heated for casting purposes and a melt of molten metal is poured into the heated mold. After the molten metal has solidified, the core is dissolved out of the casting.

In the past, cores for precision castings have been made from ceramic material, the basic substances of which are generally silicon dioxide and aluminum oxide. In such cases, the cores are dissolved out of the finished casting by means of high-viscosity metals of sodium hydroxide. However, such a dissolving operation is tedious and time-consuming. Further, in the case of small diameter and/or complex shaped cores, only a slight movement of the high-viscosity "solvent" for the ceramic core material can be produced. This greatly complicates and delays the removal of dissolved core material. In addition, ceramic cores are very brittle. This leads to high breakage rates and, in the case of small cross-section cores, complex working techniques. For example, turbine blade patterns have to be produced in two operations and with two tools using such cores. That is, the blade with the cores extending therethrough is sprayed in a practically pressureless state with almost liquid wax. The more solid blade root is then sprayed with wax in the solid/liquid range under pressure.

Accordingly, it is an object of the invention to use cores for precision castings which can simplify the casting process.

It is another object of the invention to provide a process of precision molding a casting which utilizes a core which can be readily dissolved out of a finished casting.

It is another object of the invention to use a core having improved mechanical properties to simplify pattern production.

It is another object of the invention to provide a precision casting process which requires a minimum of time for making a casting.

Briefly, the invention is directed to a process for the precision molding of castings which uses an insertable metal core which is oxidizable below the solidification temperature of the melt and the oxide of which escapes by sublimation.

In accordance with the invention, a lost pattern is first formed with at least one of the cores. Thereafter, a a ceramic mold is formed about the pattern and core and the pattern is dissolved out of the ceramic mold. Next, the ceramic mold is fired and heated to a predetermined temperature and a melt of molten metal is poured into the heated ceramic mold. The molten metal has a solidification temperature below the melting temperature of the core. After solidification of the melt, the core metal oxidizes and then sublimates to escape out of the casting.

In this process, the dissolution of the core takes place at a solid/gas interface. In the gas phase, the diffusion and mobility of the "solvent" particles are many orders of magnitude greater than in high-viscosity melts. Thus, the core dissolving operation is greatly accelerated.

It has been found that molybdenum is a suitable core material and, in the simplest case, the cores are inserted into the patterns in the form of drawn wires.

The preferred materials for a lost pattern require for the production of a ceramic mold are known to be wax and urea. When urea is used as the pattern material, there are additional advantages in the process. That is, as the last residues of the dissolved-out pattern must be removed from the ceramic mold before the melt is poured in, burning is generally carried out. In order to avoid the formation of carbon residues, molds which contain wax residues have to be exposed to elevated temperatures in an oxygen-containing atmosphere. If the temperatures used are below 300° C., this "burning-out" of the mold also requires relatively long times. Further, at higher temperatures, there is a risk of premature oxidation of the core. Contrary to this, urea pattern residues require no oxidation for their elimination. These residues can therefore be removed from the mold at any temperature with oxygen being excluded without premature oxidation occurring at the cores.

In order to obtain a directional growth of the crystals in the required casting, in some cases, it may be necessary to carry out cooling and, hence, solidification of the melt relatively slowly. The melt may then absorb a significant amount of the metal of the core material as an alloying constituent. Such a change in the composition of the casting alloy can readily be prevented if the metal core is coated with a ceramic protective layer before being inserted into the pattern. A preferred ceramic material for such a protective coating is aluminum oxide ($Al_2O_3$).

The invention will be explained in detail hereinafter with reference to exemplified embodiments.

EXAMPLE 1

The precision casting to be produced is a turbine blade for a gas turbine made from the well-known nickel-based alloy IN 738 LC, the nominal composition of which in % by weight is known to be the following: C 0.11; Cr 16.0; Co 8.5; Mo 1.7; W 2.6; Ta 1.7; Nb 0.9; Al 3.5; Ti 3.5; Zr 0.05; B 0.01 and Ni remainder.

Cooling air ducts of relatively small diameters are to extend through the required blade casting, and the cavities thereof are to be produced in the casting by means of inserted cores.

The core material used is molybdenum in the form of wires of suitable diameter, which are first placed in a chill mold for pattern production and are fixed in a conventional manner in the required position, e.g., by means of core mountings. A lost pattern for the casting is then made, for example, of urea, in the resulting mold by a die-casting process in a simple known matter.

A ceramic mold is then formed in a conventional manner for investment molds by means of this pattern. For example, the pattern is repeatedly dipped in a fused mullite dip to which an ethyl silicate binder has been added. Each layer formed by dipping is then sanded with granular fused mullite. Dipping and sanding are continued until the required mold thickness has been obtained, e.g., requiring ten dips.

The urea pattern is then conventionally dissolved out of the ceramic mold by means of water and, in order to eliminate the pattern residues, the mold is heated and fired for about 4 hours, e.g., in a suitable vacuum furnace, at a temperature of about 1000° C., in the absence of air, i.e., in a buffer gas atmosphere, e.g., of argon, or in vacuo, produced for example, by means of a Roots blower and at which a pressure of $10^{-4}$ bar is maintained.

Independently of this, and at the same time, a casting material is melted in a vacuum caster at a pressure of about $5\times10^{-4}$ bar in a conventional Si-Al-oxide crucible. The melt is heated until reaching a temperature of about 1400° C. to 1450° C.

The melt is then poured into the heated mold, again in vacuo or in a buffer gas atmosphere, at this temperature.

The mold can be exposed to air shortly after casting, so that some of the core material already oxidizes and sublimes during cooling of the casting.

If the cores have not been completely evaporated out of the casting during this operation, then the casting is reheated to about 500° C. in an oxygen-containing atmosphere. The high temperature reached in these conditions is maintained until all the core material has escaped from the casting by oxidation and sublimation.

EXAMPLE 2

A similar turbine blade from the same material as above is required to solidify with a required orientation or grow as a monocrystal.

As already stated, crystal growth of this kind is obtained by controlled and relatively slow solidification of the melt. The conditions of the process according to Example 1 must therefore be changed in a number of respects: First, the core material used is molybdenum wire pre-coated with a protective coating of ceramic material, preferably oxidic material. This coating, which in this case, consists of aluminum oxide, is deposited on the molybdenum wire by means of a plasma spraying process, using conventional well-known parameters and raw materials. The thickness of the coating, may, for example, range up to 0.1 millimeters (mm). A coating of this thickness is not self-supporting and hence collapses and can be readily removed from the casting when the molybdenum core sublimes off.

Also, the ceramic mold, in this case, consists only of a shell which is placed on a cooler in known manner. If required, the shell may additionally be enclosed by a heat retention heater which is movable axially relative to the shell in order to control the cooling conditions.

Another difference between the method of Example 2 and that of Example 1 is that the melt—and the mold as well if required—is heated to a higher temperature before casting. The mold temperature in this case is up to 1200° C., for example, while the superheating of the melt is taken to temperatures of 1500° C. to 1600° C.

What is claimed is:

1. A process for the precision molding of castings, said process comprising the steps of forming a lost pattern with at least one inserted core of a metal which is oxidizable below the solidification temperature of a melt to be cast;

thereafter forming a ceramic mold about said pattern and core;

dissolving the pattern out of the ceramic mold;

thereafter firing and heating the ceramic mold to a predetermined temperature; and pouring a melt of molten metal into the ceramic mold, whereby after solidification of the melt into a casting, the core metal oxidizes and sublimates to escape out of the casting.

2. A process as set forth in claim 1 wherein the core is made of molybdenum in wire form.

3. A process as set forth in claim 2 wherein the pattern is made of urea and wherein said step of firing and heating the ceramic mold is performed in the absence of oxygen.

4. A process as set forth in claim 3 which further comprises the step of covering the core with a ceramic protective coating prior to being placed in the pattern.

5. A process as set forth in claim 4 wherein the protective coating is a plasma sprayed aluminum oxide coating.

6. A process as set forth in claim 1 wherein the pattern is made of urea and wherein said step of firing and heating the ceramic mold is performed in the absence of oxygen.

7. A process as set forth in claim 1 which further comprises the step of covering the core with a ceramic protective coating prior to being placed in the pattern.

8. A process as set forth in claim 7 wherein the protective coating is a plasma sprayed aluminum oxide coating.

9. A process of precision casting a turbine blade comprising the steps of positioning a plurality of metal cores in a chill mold, said cores being oxidizable below the solidification temperature of a melt to be cast;

die-casting a lost pattern in the chill mold with said cores therein;

forming a ceramic mold about the pattern and cores;

dissolving the pattern out of the ceramic mold;

then heating and firing the ceramic mold at a temperature of about 1000° C. in the absence of air;

pouring a melt of casting material into the heated ceramic mold; and thereafter exposing the ceramic mold to air to permit oxidization of the cores and sublimation of the cores out of the casting material during cooling of the casting material into a casting.

10. A process as set forth in claim 9 wherein the casting material is at a temperature of about 1400° C. to 1450° C.

11. A process for precision casting a turbine blade comprising the steps of positioning a plurality of molybdenum wires with a coating of ceramic material thereon in a chill mold;

die-casting a lost pattern in the chill mold with said wires therein;

forming a ceramic mold about the pattern and wires;

dissolving the pattern out of the ceramic mold;

then heating and firing the ceramic mold at a temperature of about 1200° C. in the absence of air;

pouring a melt of casting material at a temperature of about 1500° C. to 1600° C. into the heated ceramic mold; and thereafter exposing the ceramic mold to air to permit oxidization of the wires and sublimation of the wires out of the casting during cooling of the casting material into a casting.

* * * * *